US006721699B2

(12) United States Patent
Xu et al.

(10) Patent No.: US 6,721,699 B2
(45) Date of Patent: Apr. 13, 2004

(54) METHOD AND SYSTEM OF CHINESE SPEECH PITCH EXTRACTION

(75) Inventors: Bo Xu, Beijing (CN); Liang He, Shanghai (CN); Wen Ke, Beijing (CN)

(73) Assignee: Intel Corporation, Santa Clara, CA (US)

( * ) Notice: Subject to any disclaimer, the term of this patent is extended or adjusted under 35 U.S.C. 154(b) by 161 days.

(21) Appl. No.: 10/011,660

(22) Filed: Nov. 12, 2001

(65) Prior Publication Data

US 2003/0093265 A1 May 15, 2003

(51) Int. Cl.[7] ..... G10L 11/04
(52) U.S. Cl. ..... 704/207
(58) Field of Search ..... 704/207, 208, 704/209, 214, 216, 217

(56) References Cited

U.S. PATENT DOCUMENTS

| | | | |
|---|---|---|---|
| 6,073,100 | A | 6/2000 | Goodridge, Jr. |
| 6,195,632 | B1 | 2/2001 | Pearson |
| 6,226,606 | B1 | 5/2001 | Acero et al. |

FOREIGN PATENT DOCUMENTS

| | | | |
|---|---|---|---|
| WO | WO 01/35389 | A1 | 5/2001 |

OTHER PUBLICATIONS

Boersma, Paul; Accurate Short–Term Analysis Of The Fundamental Frequency And The Harmonics–To–Noise Ratio Of A Sampled Sound; Institute Of Phonetic Sciences, University of Amsterdam; Proceedings 17 (1993), pp. 97–110.

Hermes, Dik J.; Measurement of pitch by subharmonic summation; J. Acoust. Soc. Am. 83 (1), Jan. 1988, ©1988 Acoustical Society of America, pp. 257–264.

Liu, PH.D., Sharlene, et al.; The Effect of Fundamental Frequency on Mandarin Speech Recognition; 5$^{th}$ International Conference on Spoken Language Processing; 30$^{th}$ Nov.–4$^{th}$ Dec. 1998, Sydney, Australia, ICSLP '98 Proceedings Th4R9, vol. 6, pp. 2647–2650.

Rabiner, Lawrence R., et al; A Comparative Performance Study of Several Pitch Detection Algorithms; IEEE Transactons On Acoustics, Speech, And Signal Processing, vol. ASSP–24, No. 5, Oct. 1976, pp. 399–418.

Search Report for PCT/US 02/35949, mailed Feb. 6, 2003, 2 pages.

Pearce, David, *Enabling New Speech Driven Services for Mobile Devices: An overview of the ETSI standards activities for Distributed Speech Recognition Front–ends*, AVIOS 2000: The Speech Applications Conference, May 22–24, 2000, San Jose, CA, USA., <http://www.etsi.org/T_news/Documents/AVIOS DSR paper.pdf>, 12 pages.

*Distributed Speech Recognition –Aurora*, Oct. 1, 2002, <http://www.etsi.org/technicalactiv/dsr.htm>, pp. 1–3.

*Speech Processing, Transmission and Quality aspects (STQ); Distributed speech recognition; Frontend feature extraction algorithm; Compression algorithms*, ETSI ES 201 108 V1.12 (Apr. 2000)., ETSI Standard, ©European Telecommunications Standards Institute 2000, F–06921 Sophia Antipolis Cedex–France, pp. 1–20.

WebSphere Transcoding Publisher, IBM ®Products & Services>Software>Web Application Servers, http://www.–3.ibm.com/software/webservers/transcoding/about.html, 4 pages.

Written Opinion for PCT/US 02/35949, mailed Oct. 23, 2003, 1 page.

*Primary Examiner*—Susan McFadden
(74) *Attorney, Agent, or Firm*—Blakely, Sokoloff, Taylor & Zafman LLP

(57) ABSTRACT

A method and system for Chinese speech pitch extraction is disclosed. The method and system for Chinese speech pitch extraction comprises: pre-computing an anti-bias autocorrelation of a Hamming window function; for at least one frame, saving a first candidate as an unvoiced candidate, and detecting other voiced candidates from the anti-bias autocorrelation function; and calculating a cost value for a pitch path according to a voiced/unvoiced intensity function based on the unvoiced and voiced candidates, saving a predetermined number of least-cost paths, and outputting at least a portion of contiguous frames with low time delay.

29 Claims, 7 Drawing Sheets

METHOD AND SYSTEM OF CHINESE SPEECH PITCH EXTRACTION

FIELD OF THE INVENTION

The present invention relates to the field of speech recognition. More specifically, the present invention relates to a method and system for Chinese speech pitch extraction in speech recognition using local optimized dynamic programming pitch path-tracking.

BACKGROUND OF THE INVENTION

Pitch extraction is an essential component in a variety of speech processing systems. Besides providing valuable insights into the nature of the excitation source for speech production, the pitch contour of an utterance is useful for recognizing a speaker, and is required in almost all speech analysis-synthesis systems. Because of the importance of pitch extraction, a wide variety of methods and systems for pitch extraction have been proposed in the speech recognition field.

Basically, the method or system for pitch extraction makes a voiced/unvoiced decision, and during the periods of voiced speech, provides a measurement of the pitch period. Methods and systems for pitch extraction can be roughly divided into the following three broad categories:

1. A group which utilizes principally the time-domain properties of speech signals.
2. A group which utilizes principally the frequency-domain properties of speech signals.
3. A group which utilizes both the time and frequency domain properties of speech signals.

Time-domain pitch extractors operate directly on the speech waveform to estimate the pitch period. For these pitch extractors, the measurements most often made are peak and valley measurements, zero-crossing measurements, and auto-correction measurements. The basic assumption that is made in all these cases is that if a quasi-periodic signal has been suitably processed to minimize the effect of the format structure, then simple time-domain measurements will provide good estimates of the period.

The class of frequency-domain pitch extractors uses the property that if the signal is periodic in the time domain, then the frequency spectrum of the signal will consist of a series of impulses at the fundamental frequency and its harmonics. Thus, simple measurements can be made on the frequency spectrum of the signal to estimate the period of the signal.

The class of hybrid pitch extractors incorporates features of both the time-domain and the frequency-domain approaches to pitch extraction. For example, a hybrid extractor might use frequency-domain techniques to provide a spectrally flattened time waveform, and then use autocorrelation measurements to estimate the pitch period.

Though the above conventional methods and systems for pitch extraction are accurate and reliable, they are only suitable for feature analysis, and not for speech recognition in real time. In addition, due to the differences between most European languages and the Chinese language, there are some special aspects to be taken into account for Chinese speech pitch extraction.

In contrast to most European languages, Mandarin Chinese uses tones for lexical distinction. A tone occurs over the duration of a syllable. There exist five lexical tones that play very important roles in meaning disambiguation. The direct acoustic representative of these tones is the pitch contour variation pattern illustrated in FIG. 1. The most direct acoustic manifestation of tone is fundamental frequency. Thus, for Chinese speech pitch extraction, the effect of fundamental frequency shall be taken into account.

Paul Boersma's article entitled "Accurate short-term analysis of the fundamental frequency and the harmonics-to-noise ratio of a sampled sound," IFA Proceedings 17, 1993, pp. 97–110, gives a detailed and advanced pitch extraction method based on the processing of fundamental frequency. The main concept of Paul Boersma's article includes the anti-bias auto-correlation and viterbi algorithm (Dynamic Programming) technology, which integrates the voiced/unvoiced decision, pitch candidate estimator, and best path finding into one pass and can efficiently improve the extraction accuracy.

However, the global optimized dynamic programming pitch path-tracking of Paul Boersma is not suitable for practical application for time delay. The time delay of pitch extraction depends on two factors: one is the CPU computation power and another is the algorithm structural issue. As in the algorithm of Paul Boersma, when pitch extraction in current windows (frames) depends on the later windows (frames), whatever the CPU speed is, the system will have structural delay for response. For example, in the algorithm of Paul Boersma, if the speech length is L seconds, then the structural delay time is L seconds. Sometimes it is unacceptable for a real-time speech recognition application. Therefore, it is apparent to one with ordinary skill in the art that an improved method and system is needed.

SUMMARY OF THE INVENTION

The present invention discloses methods and apparatuses for Chinese speech pitch extraction using local optimized dynamic programming pitch path-tracking to meet the low time-delay requirements for a real-time speech recognition application.

In one aspect of the invention, an exemplary method includes:

pre-computing an anti-bias auto-correlation of a Hamming window function; for at least one frame, saving a first candidate as an unvoiced candidate, and detecting other voiced candidates from the anti-bias auto-correlation function; and calculating a cost value for a pitch path according to a voiced/unvoiced intensity function based on the unvoiced and voice candidates, saving a predetermined number of least-cost paths; and outputting at least a portion of contiguous frames with low time delay.

In one particular embodiment, the method includes removing global and local DC components from the speech signal. In another embodiment, the method includes segmenting the speech signal into a plurality of frames, and for each frame, calculating spectrum, power spectrum, and auto-correlation. In a further embodiment, the method includes performing an MFCC extraction.

The present invention includes apparatuses which perform these methods, and machine-readable media which, when executed on a data processing system, cause the system to perform these methods. Other features of the present invention will be apparent from the accompanying drawings and from the detailed description which follows.

BRIEF DESCRIPTION OF THE DRAWINGS

The features of the present invention will be more fully understood by reference to the accompanying drawings, in which.

DETAILED DESCRIPTION

In the following detailed description, numerous specific details are set forth in order to provide a thorough understanding of the invention. However, it will be appreciated by one of ordinary skill in the art that the present invention shall not be limited to these specific details.

Figure 7:
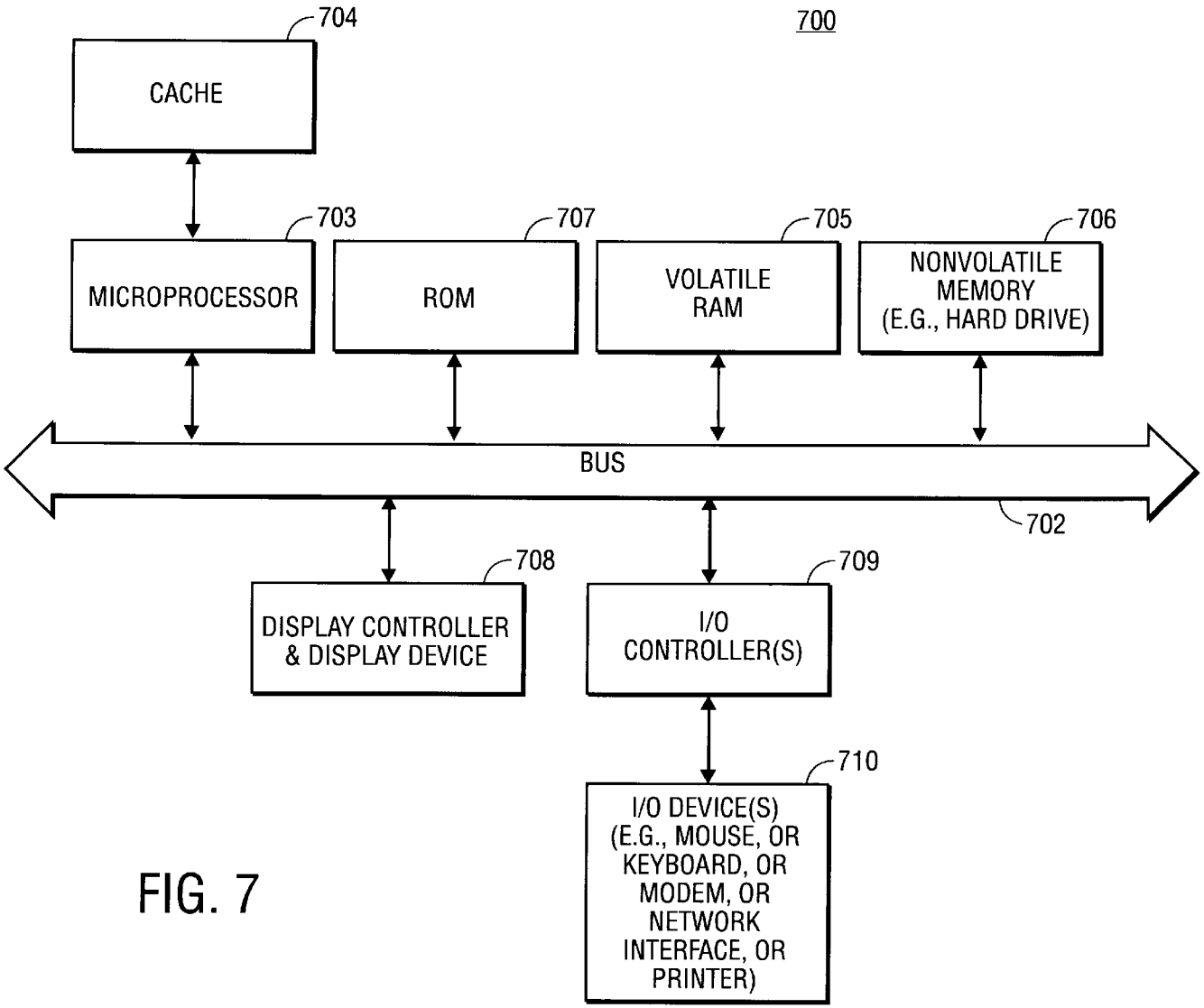
FIG. 7 is a block diagram of a computer system which may be used with the present invention.

FIG. 7 shows one example of a typical computer system which may be used with the present invention. Note that while FIG. 7 illustrates various components of a computer system, it is not intended to represent any particular architecture or manner of interconnecting the components, as such details are not germane to the present invention. It will also be appreciated that network computers and other data processing systems which have fewer components or perhaps more components may also be used with the present invention. The computer system of FIG. 7 may, for example, be an Apple Macintosh or an IBM-compatible computer.

As shown in FIG. 7, the computer system 700, which is a form of a data processing system, includes a bus 702 which is coupled to a microprocessor 703 and a ROM 707 and volatile RAM 705 and a non-volatile memory 706. The microprocessor 703, which may be a Pentium microprocessor from Intel Corporation, is coupled to cache memory 704 as shown in the example of FIG. 7. The bus 702 interconnects these various components together, and also interconnects these components 703, 707, 705, and 706 to a display controller and display device 708 and to peripheral devices such as input/output (I/O) devices, which may be mice, keyboards, modems, network interfaces, printers, and other devices which are well-known in the art. Typically, the input/output devices 710 are coupled to the system through input/output controllers 709. The volatile RAM 705 is typically implemented as dynamic RAM (DRAM), which requires power continuously in order to refresh or maintain the data in the memory. The non-volatile memory 706 is typically a magnetic hard drive or a magnetic optical drive or an optical drive or a DVD RAM or other type of memory system which maintains data even after power is removed from the system. Typically, the non-volatile memory will also be a random access memory, although this is not required. While FIG. 7 shows that the non-volatile memory is a local device coupled directly to the rest of the components in the data processing system, it will be appreciated that the present invention may utilize a non-volatile memory which is remote from the system, such as a network storage device which is coupled to the data processing system through a network interface such as a modem or Ethernet interface. The bus 702 may include one or more buses connected to each other through various bridges, controllers, and/or adapters, as is well-known in the art. In one embodiment, the I/O controller 709 includes a USB (Universal Serial Bus) adapter for controlling USB peripherals.

The present invention is a method and system for Chinese speech pitch extraction by using local optimized dynamic programming pitch path-tracking to meet the low time-delay requirements for many real-time speech recognition applications.

The invention uses a precise estimation of auto-correlation and a low time-delay local optimized dynamic pitch path-tracking process, which ensures smoothness of pitch variation. With this invention, a speech recognizer can effectively utilize pitch information and improve performance for tonal language speech recognition, such as Chinese. Further, the invention combines the computation flow considering the Mel Frequency Capstral Coefficients (MFCC) feature extraction, which is the most commonly adopted feature for all language speech recognition. Thus, the increased calculation resources in speech feature extraction are relatively small.

The method for Chinese speech pitch extraction in speech recognition according to the invention, may include the following main components:

Preprocessing: pre-computing the anti-bias auto-correlation of a Hamming window function, Hamming windowing for speech for short-term analysis, and removing global and local DC components;

Pitch candidate's estimating: for every frame, saving the first candidate as an unvoiced candidate, and detecting other voiced candidates from the anti-bias auto-correlation function; and Local optimized dynamic programming pitch path-tracking: when a new frame of speech is received, calculating the cost value for every possible pitch path according to a voiced/unvoiced intensity function and transmit cost function, saving a predetermined number of least-cost paths in the path stack, and outputting the frames continuously with low time delay.

The system for Chinese speech pitch extraction in speech recognition according to the invention includes the following components:

Preprocessor: including a pre-calculator for calculating the anti-bias auto-correlation of a Hamming window function, Hamming windowing processor for performing windowing processing for speech for short-term analysis, and a processor for removing global and local DC components;

Pitch candidate's estimator: for every frame, saving the first candidate as an unvoiced candidate, and detecting other voiced candidates from the anti-bias auto-correlation function; and Local optimized dynamic programming processor: when a new frame of speech is received, calculating the cost value for every possible pitch path according to a voiced/unvoiced intensity function, transmitting the cost function, saving a predetermined number of least-cost paths in the path stack, and outputting the frames continuously with low time delay.

Figure 4:
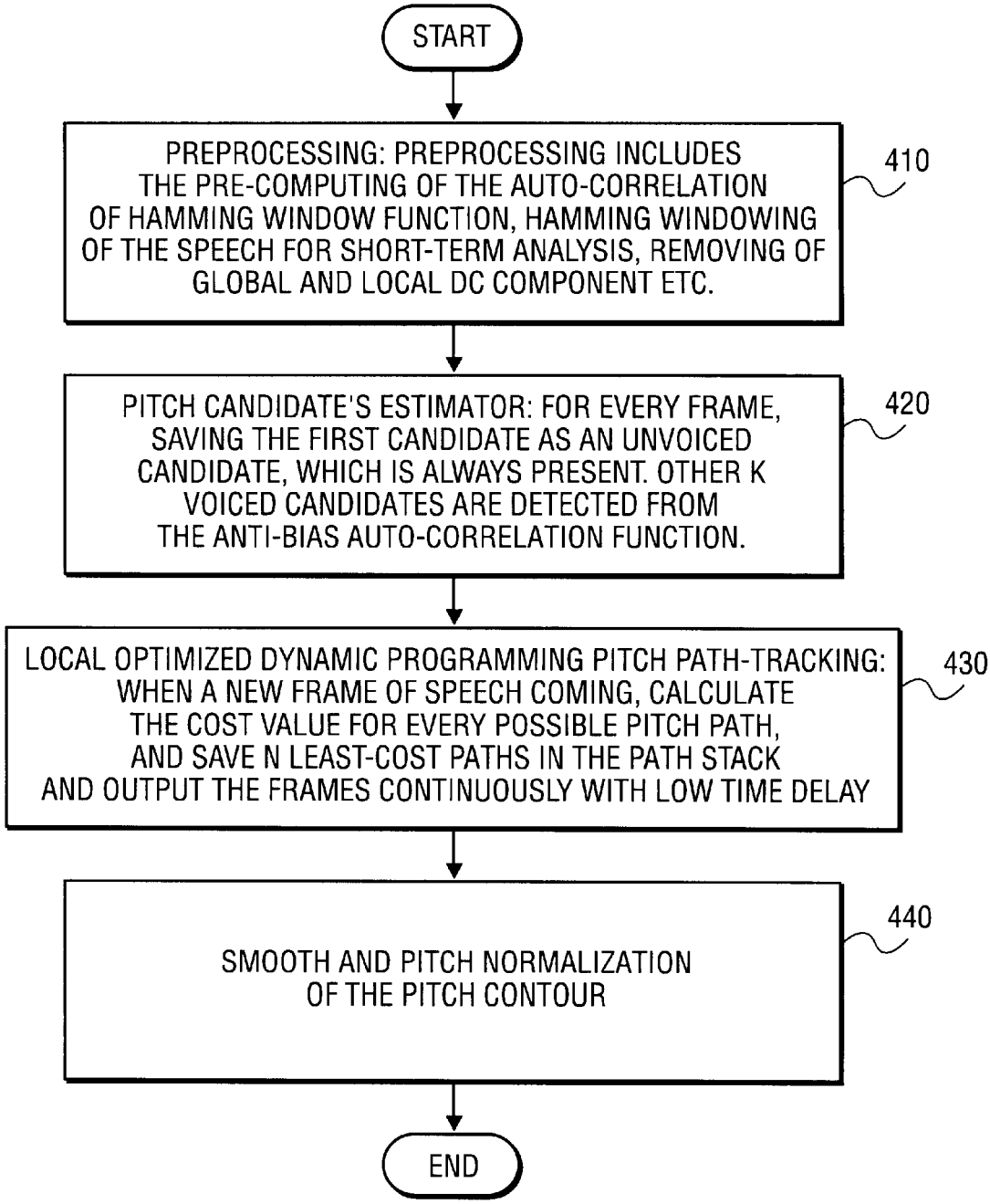
FIG. 4 is a flowchart diagram of one embodiment of a method for Chinese speech pitch extraction according to the present invention.

As shown in FIG. 4, the method for Chinese speech pitch extraction of the invention includes the following components:

Preprocessing 410: For this speech recognition application, because Mel Frequency Cepstral Coefficients (MFCC) feature analysis is necessary in this case, preprocessing includes the pre-computing of the auto-correlation of the Hamming window function, Hamming windowing of the speech for short-term analysis, removal of global and local DC components, etc. The inventive method uses an anti-bias auto-correlation function, which is a modified auto-correlation function. We adopt this function to perform an auto-correlation based pitch extraction, as it is more accurate than the usual auto-correlation function.

Pitch Candidate's Estimator 420: For every frame, the inventive method includes saving the first candidate as an unvoiced candidate, which is always present. Other K voiced candidates are detected from the anti-bias auto-correlation function. In this application a reasonable strength value is defined for every candidate.

Local Optimized Dynamic Programming Pitch Path-Tracking 430: Principally, the pitch value cannot make abrupt changes for continuous frames in speech. Based on this principle, and considering the limitation of pitch value range for human speech, a cost function is revised for the pitch path. When a new frame of speech is received, a cost value is calculated for every possible pitch path, and N least-cost paths are saved in the path stack and the frames are outputted continuously with low time delay.

Smoothing and Pitch Normalization of the pitch contour 440: In Chinese speech recognition systems, initial/final stages are taken as the modeling unit for Mandarin. Because most of the initial stage is unvoiced speech and most of the final stage is voiced speech, there is a pitch discontinuity between initial/final stages for pitch contour. Pitch contour is smoothed to meet the Hidden Markov Model (HMM) modeling requirement. Because the dynamic range is very important in a clustering algorithm, we normalize the pitch to the range of 0.7–1.3 by dividing the average pitch to balance the clustering algorithm with other feature dimensions.

The last two components of the present invention described herein are especially designed for the requirements of speech recognition.

In one embodiment, the invention is primarily focused on:

1) Local Optimized Dynamic Programming Pitch Path-Tracking:

One of the main advantages in the conventional pitch extraction of Paul Boersma (cited above) is the introduction of global dynamic programming for finding the best path among the pitch candidates' matrices calculated from the following equation:

$$p=\arg\ MaxR(i), i=1, \ldots, N-1$$

where R(i) represents the ith auto-correlation coefficient.

In order to make a more precise voiced/unvoiced decision, Boersma utilizes a global pitch path-tracking algorithm to do voiced/unvoiced decision-making. To do this, the algorithm in Boersma preserves an unvoiced candidate $C_0$ for every frame and K voiced candidate, respectively. Frequency corresponding to the unvoiced candidate is defined as zero: $F(C_0)=0$. Also, the algorithm defines the intensity for the unvoiced candidate $C_0$ and voiced candidates individually.

In the above framework, two factors cause the structural delay of pitch extraction. One is the parameter NormalizedEnergy. NormalizedEnergy is the globally normalized energy value of this frame, wherein NormalizedEnergy is used to measure the intensity of the unvoiced candidate. This improves the robustness of our pitch extractor in noisy environments, especially when the noise exists as a pulse form. However, calculating the globally normalized energy value delays the pitch extraction. Another factor that causes the structural delay is the global search for the best path. Only when the end of speech can be detected is the best path finalized and traced back. Both factors cause N frames of time-delay if speech length is N frames.

Figure 1:
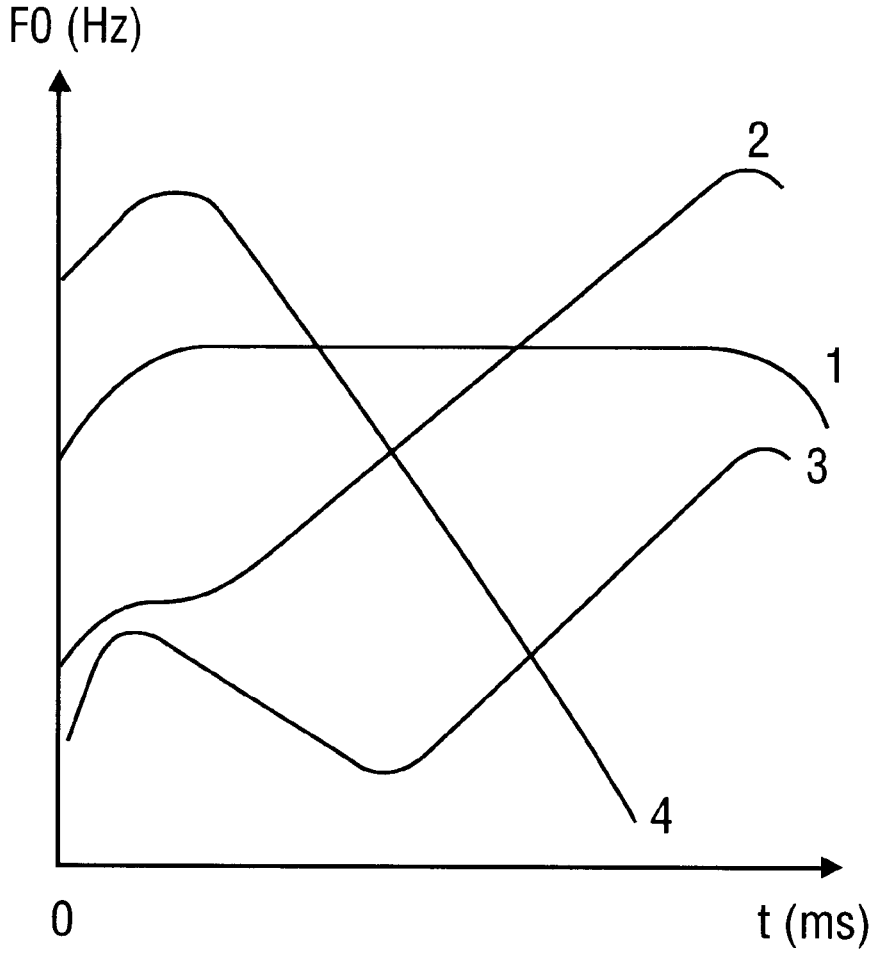
FIG. 1 (PRIOR ART)
FIG. 1 illustrates five main lexical tones in Mandarin.
Figure 2:
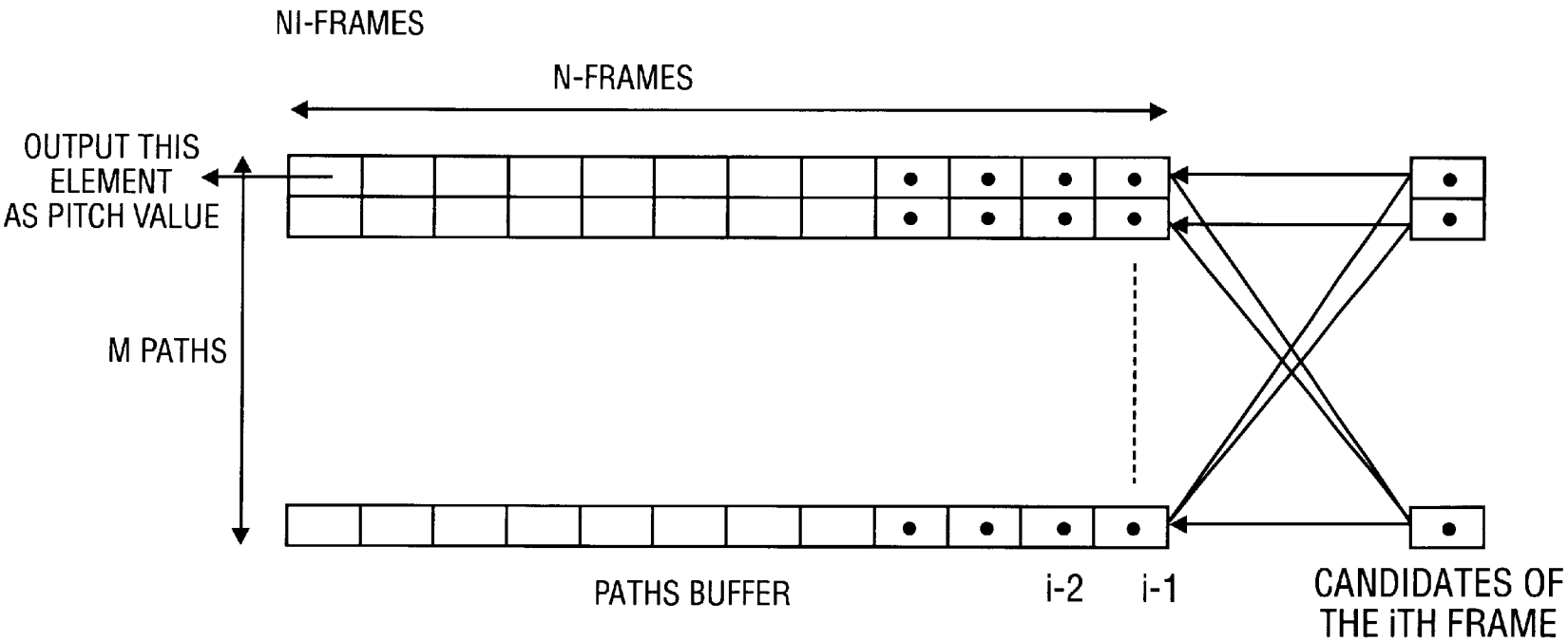
FIG. 2 illustrates a dynamic search process.

In global search algorithms, pitch-path is saved in an M×N matrix illustrated as FIG. 2. Every element of this matrix represents the pitch value. Every row of this matrix represents a candidate pitch-path. All M pitch paths in this matrix are sorted in a descending manner by path cost at the current time. When the ith frame speech signal is received, the path cost is calculated for every possible extension of the existing paths according to the following:

$$\text{PathCost}\{\text{Path}_{i-1}{}^{m}, C_i^k\} \text{for all } m=1 \ldots M, k=1 \ldots K$$

where $\text{Path}_{i-1}{}^{m}$, m=1 . . . M is the path existing at the time of i−1, and $C_i^k$, k=1 . . . K is the detected candidate of the ith frame. The system selects the M least-cost paths, sorts them in a descending order and prunes part of them out of M, and inserts them into the pitch-path matrix. When i=N, the top raw candidate is outputted in the pitch-path matrix, which is globally optimized.

However, the local optimized pitch-path-tracking algorithm of the present invention checks the variation of elements in the best path between continuous L frames, say from t=i−(L−1) to t=i. If the elements in the best path remain unchanged for continuous L frames, then we output continuous elements and clear part of the pitch-path matrix and paths.

In our experiments, we observe that L=5 is typically enough, and that usually the delay of pitch output is approximately 10 frames; thus the delay caused by this algorithm is small. In our system, the average delay time is approximately 120 ms.

In order to meet the requirements for real-time applications, we modified the globally normalized energy value as follows:

$$\text{NormalizedEnergy}=\text{EnergyOfThisFrame}/\text{MaximumEnergy}$$

where MaximumEnergy is a running maximum energy value calculated from previous history and updated when the pitch output of frames is available.

Using the local optimized search as described above, there is no damage to accuracy. Also, the system and method of the present invention described herein reduces the memory cost.

2) More Constrained Target Function:

In order to improve the accuracy and save computation resources, we can reasonably limit our detection in the range of $[F_{min}, F_{max}]$. That is, when we find the places and heights of the local maximum of R*(m), the only places considered for the maximum are those that yield a pitch between $[F_{min}, F_{max}]$. In our algorithm, $F_{min}$=100 Hz, $F_{max}$=500 Hz, this limitation is reasonably based on characteristics of human pronunciation.

Because harmonic frequencies always exist in the speech signal, we should favor higher fundamental frequencies. Thus, we could not use the local maximum values of R*(m) directly as intensity values for voiced candidates. We propose a new measure of voiced and unvoiced intensity calculation, and transmit a cost calculation as follows:

Unvoiced intensity calculation formula:

$$I(C_0)=\text{VoicingThreshold}+(1.0-\sqrt{\text{NormalizedEnergy}})^2(1.0-\text{VoicingThreshold})$$

Voiced intensity calculation formula:

$$I(C_k) = R^*(m_k) * \left(\text{Minimum Weight} + \frac{\log_{10}[F(C_k) - F_{\min}]}{\log_{10}[(F_{\max}) - F_{\min}]} * (1.0 - \text{Minimum Weight})\right)$$

Transmit cost calculation formula:

$$\text{TransmitCost}(F_{i-1}, F_i)=\text{TransmitCoefficient}\ \log_{10}(1+|F_{i-1}-F_i|)$$

We compute taking the path cost function for a pitch path until the ith frame as follows:

$$\text{Cost}\{\text{path}\} = \sum_{i=2}^{numberofframes} \text{Transmit Cost}(F_{i-1}, F_i) - \sum_{i=1}^{numberofframes} I_i$$

By constraining the pitch range to a range common in real human speech, the path-tracking algorithm can extract pitch more accurately.

3) Postprocessing: Smoothing and Normalization of Pitch Contour:

The smoothing of the pitch contour improves the robustness of the acoustic modeling and reduces the sensitivity of the whole system. In the method of C. Julian Chen, et al., "New methods in continuous Mandarin speech recognition," EuroSpeech 97, pp. 1543–1546, an exponential function is proposed. For some previous conventional pitch extraction algorithms, Voiced/Unvoiced decisions are not very reliable. Some unexpected pitch pulses often exist during the transition between the unvoiced segment and the voiced segment. The exponential function may be useful for smoothing these unreliable pitch-values, but when the voiced/unvoiced decision is very reliable, the advantage of exponential smoothing function is gone. Furthermore, exponential smoothing will damage the reliable pitch contour and will make the pitch contour too smooth, thereby damaging the discriminative characteristics of the pitch pattern. In this invention, we constrain the pitch values of the voiced region directly.

Figure 3:
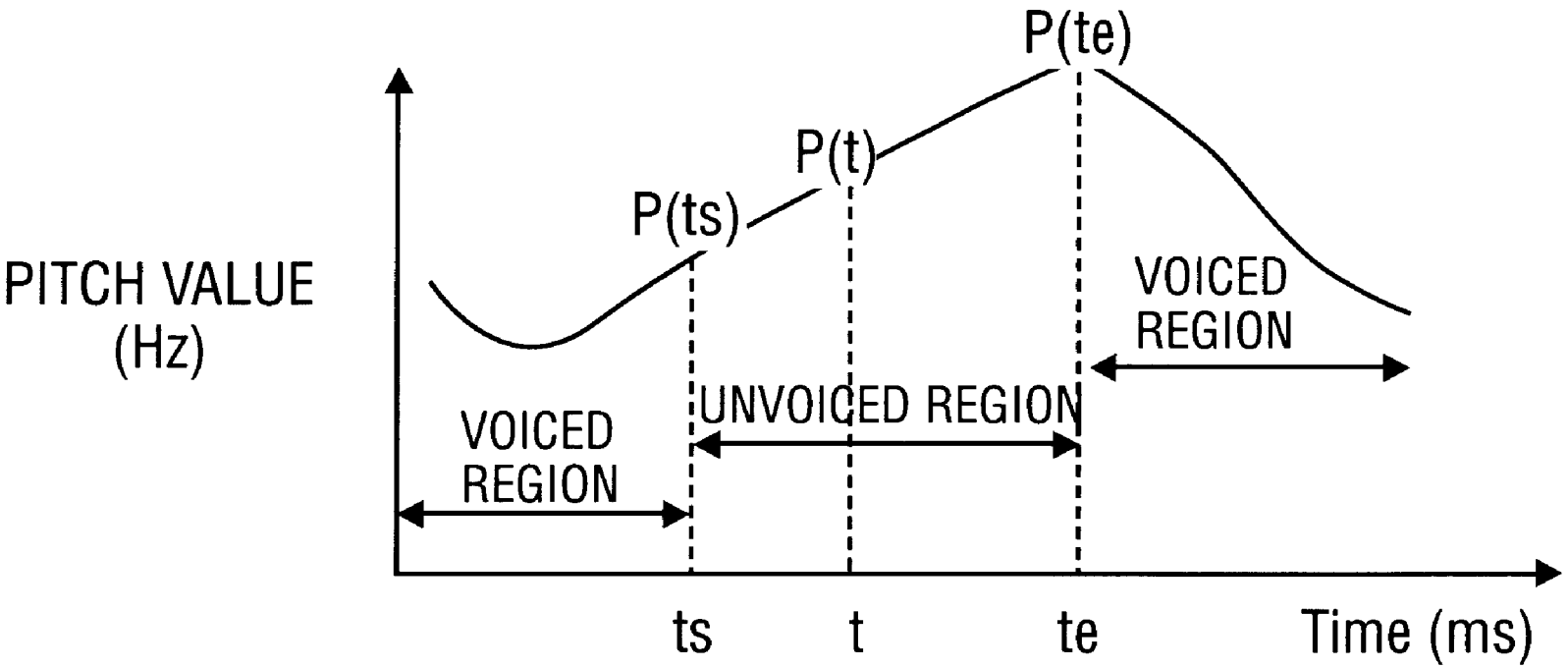
FIG. 3 illustrates the smooth process of pitch contour.

As shown in the FIG. 3, for the unvoiced region, the smoothed pitch value is:

$$P(t) = P(t_s) + \frac{t - t_s}{t_e - t_s}[P(t_e) - P(t_s)]$$

Here, the voiced pitch will remain unchanged during smoothing, while the unvoiced part will be kept noisily valued through its neighboring voiced pitch value. Again, we find that if the final element of output from the local optimized path is unvoiced frames, then here we have additional time delay because of the smoothing requirement. Thus, in one embodiment of the present invention, we revise the Local Optimized Search algorithm to search for the last voiced element that remains unchanged within continuous L frames and to output all the elements prior to this one element at the same time. In this way, we can easily smooth the pitch contour of all of the unvoiced frames without any additional delay in the smoothing component. Generally, the time delay due to waiting for voiced frames in the local optimized search increases to approximately 12 frames. This level of delay is quite acceptable for most speech recognition applications.

In conventional speech recognition systems, a lot of clustering algorithms at various levels are used, and the MFCC feature value usually is between (−2.0,2.0). As such, the pitch normalization is necessary to improve speech recognition accuracy. Considering the real-time requirements, the normalized pitch value is calculated as follows:

$$\text{NormalizedPitchValue}=\text{PitchValue}/\text{AveragePitchValue}$$

Here, AveragePitchValue is a running average calculated from previous history and updated continuously when some pitch frame segments are output. Based on the pitch variation range for five lexical tones, the normalized pitch range is typically between (0.7–1.3).

Because of the local optimized search used in the present invention, the time delay is reduced. Because of the short stack needed in the local optimized search, search space and memory requirements are also reduced. This is especially important for Distributed Speech Recognition (DSR) client cases, because a typical mobile device is usually memory-sensitive and computation-sensitive. Also, the invention makes any delay associated with smoothing and normalized localization very controllable. In one embodiment, pitch values are normalized to the range of 0.7–1.3 by dividing the moving average of pitch values.

As described in above, our invention includes the local optimized search and the corresponding postprocessing of the pitch value.

Figure 5:
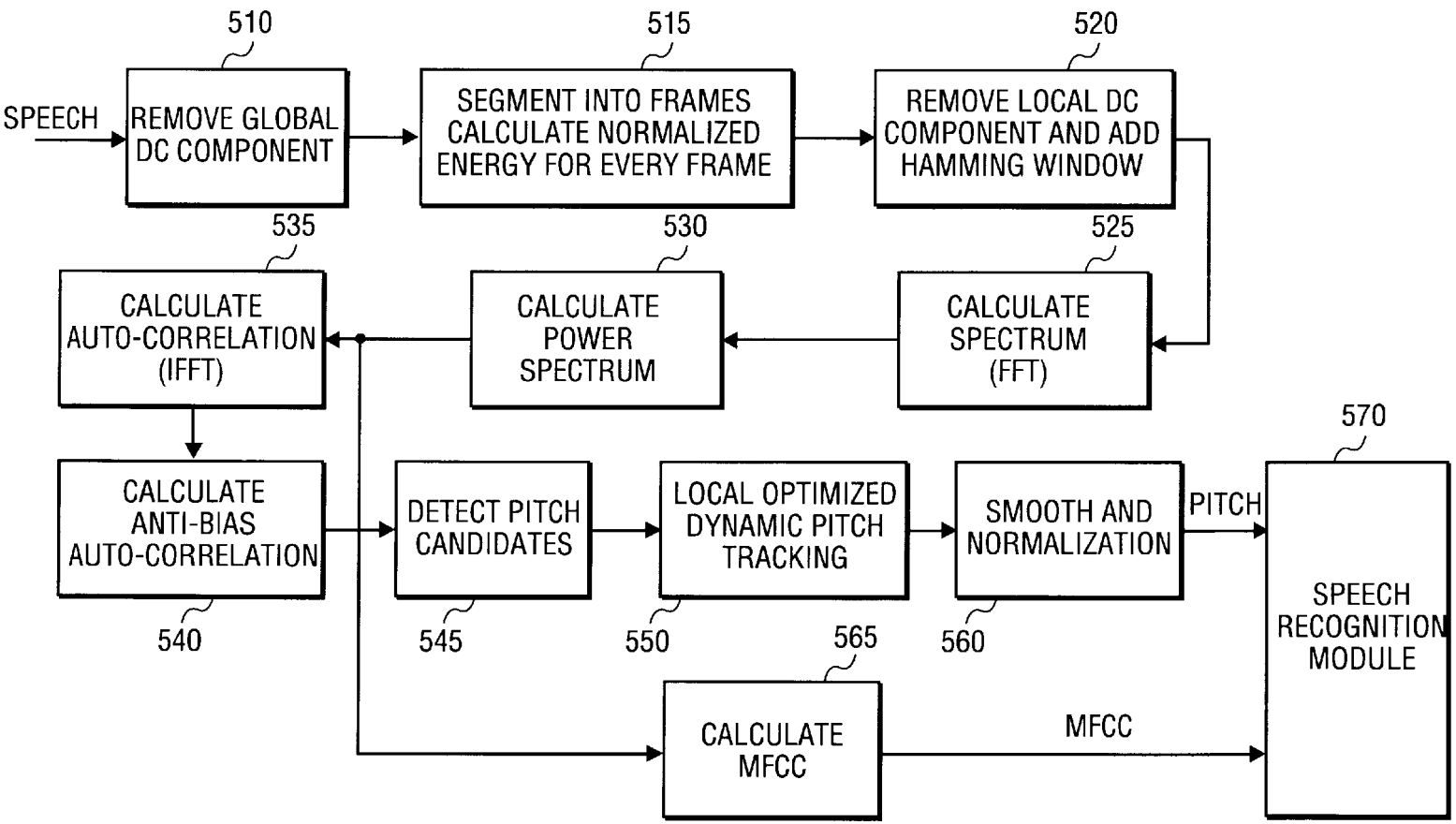
FIG. 5 is a flowchart diagram of a more detailed scheme for the method of FIG. 4.

FIG. 5 illustrates a more detailed flow diagram of the system and method of the present invention. Referring to FIG. 5, each of the components of the process and system of the present invention are described in more detail below.

1. Calculate the auto correlation function for hamming window:

$$R_w(m) = \frac{1}{N}\sum_{n=0}^{N-1-|m|} \text{hamming}(n)\text{hamming}(n+m)$$

The length of the hamming window N is corresponding to 24 ms.

2. Remove global DC component: Prior to the framing, a notch filtering operation is applied to the digital samples of the input speech signal $S_{in}$ to remove their DC offset, producing the offset-free input signal $S_{of}$ (block 510).

$$s_{of}(n)=s_{in}(n)-s_{in}(n-1)+0.999*s_{of}(n-1)$$

3. Segment the speech signal into frames (block 515). In one embodiment, the frame length is 24 ms, the frame shift step is 12 ms.

4. Compute the normalized energy for every frame (block 515).

5. For i=1:totalframenumber, do following steps:

Remove local DC components for the ith frame (block 520).

Add hamming window for the ith frame (block 520).

$$x_i(n)=x(n)*\text{hamming}(n-i*N)$$

Compute the fast Fourier transform (FFT) for the ith frame (block 525).

$$H_i(\omega)=\text{FFT}(x_i(n))$$

Compute power spectrum for the ith frame (block 530).

$$P_i(\omega)=H_i^2(\omega)$$

Do IFFT, get the auto-correlation for the ith frame (block 535).

$$\hat{R}_i(m)=\text{IFFT}(P_i(\omega))$$

Calculate the anti-bias auto-correlation for the ith frame (block 540).

$$R_i^*(m) = \frac{\hat{R}_i(m) / \hat{R}_i(0)}{R_w(m) / R_w(0)}$$

Pitch Candidate Estimator (block 545):

Set the preserved unvoiced candidate, calculate its intensity $I(C_0)$.

Detect the top K candidates $C_k$,k=1,2, . . . ,K from local maximum of $R^*_i(m)$, calculate their frequencies $F(C_k)$ and intensities $I(C_k)$.

Local Optimized Pitch path tracking and post-processing (block 550):

If at time i−1, there are M sorted paths $$Path_{i-1}^m, (m=1, \ldots, M).$$

At time i, when the ith frame speech signal comes, we extend the pitch path through the cost function $$PathCost\{Path_{i-1}^m, C_i^k\}, \text{ for all } m=1, \ldots, M, k=1, \ldots, K$$

Sort the extended paths in descending order and prune paths out of M order. We get the $Path_i^m$,m=1, . . . ,M Taking the best paths, we construct the following sequence:

$$Path_1^1, Path_2^1, \ldots Path_i^1$$

$$\text{Here } Path_i^1 = \{P_i^1, P_i^2, \ldots P_i^{N_i}\}$$

Find the last pitch element $P_i^h$ in $Path_i^1$ that meets the following requirements:

1). Voiced (which means $P_i^h \neq 0$)

2). $P_i^h$ remains unchanged from t=i−(L−1) to t=i in the best path sequences.

If $P_i^h$ is found, do the following (block 560):

Output $P_i^0 \ldots P_i^h$

Clear part of path buffer

Smooth if unvoiced regions exist

Perform normalization

Update (MaximumEnergy, NormalizedEnergy) and AveragePitch as follows:

MaximumEnergy=max(MaximumEnergy, EnergyOfOutputed-Frame)

$$NormalizedEnergy = \frac{EnergyOfFramesInThePathBuffer}{MaximumEnergy}$$

$$AveragePitch = \frac{AveragePitch + AveragePitchOfOutputedFrames}{2}$$

else continue.

If this is the last frame, output the least cost pitch path in the path stack and terminate pitch extraction processing (block 560).

Figure 6:
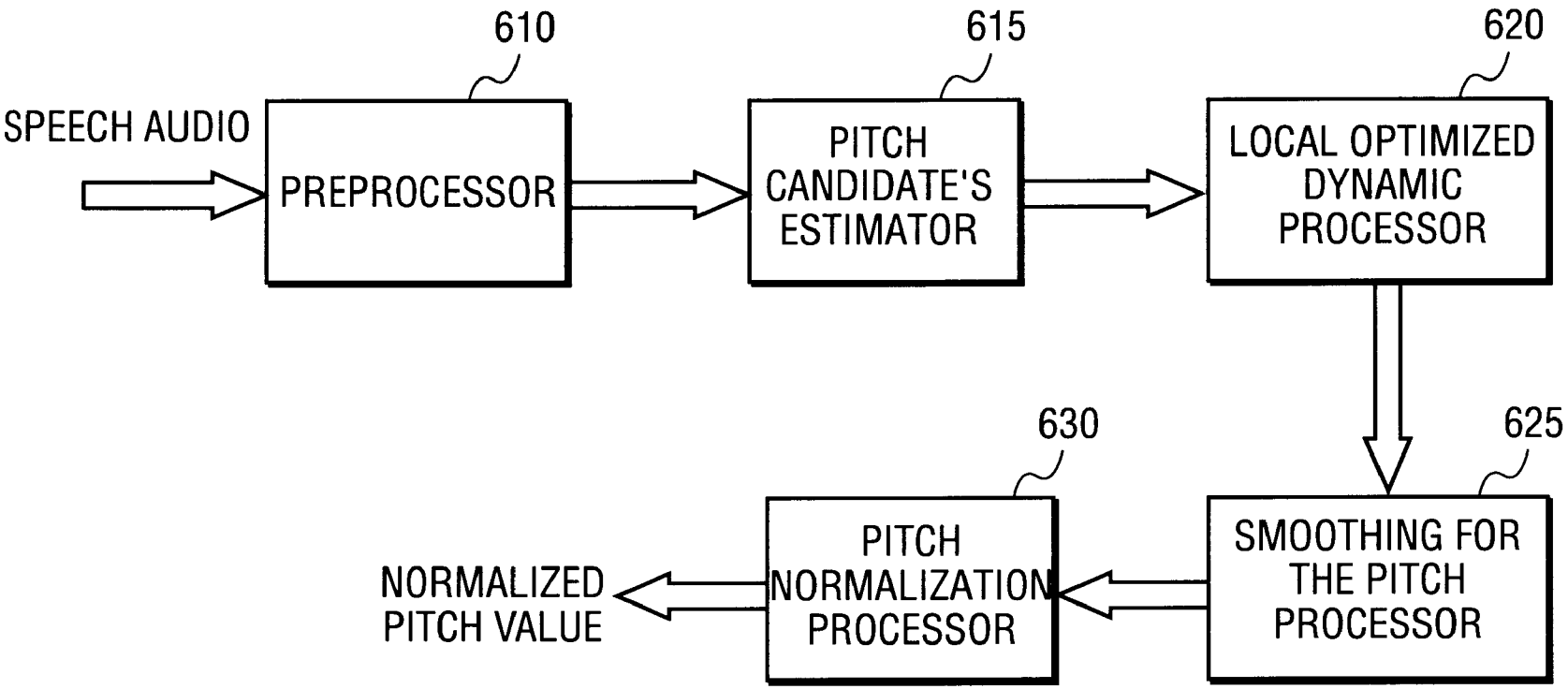
FIG. 6 is a block diagram of one embodiment of a method for Chinese speech pitch extraction according to the present invention.

FIG. 6 is a block diagram of a system for Chinese speech pitch extraction according to one embodiment of the present invention. The system includes: a preprocessor (610); pitch candidate's estimator (615); local optimized dynamic programming processor (620); smoothing processor for smoothing the pitch contour (625); and pitch normalization processor (630). The last two components (625 and 630) are especially designed for the requirements of speech recognition.

As discussed in the above sections, our invention uses local optimized dynamic programming pitch path-tracking instead of global pitch tracking in order to meet the low time-delay requirements for many real-time speech recognition applications. In order to maintain accuracy, we define a more constrained target function for pitch path. We use a new method to measure the intensity for every pitch candidate and a new method to compute frequency weight for voiced candidates. All of these modifications make the voiced/unvoiced decision more reliable and the resulting pitch extraction more accurate. The present invention also reduces memory cost. All the modifications provided by the present invention help to improve the performance and feasibility of the real-time speech recognizer, especially in a DSR client application.

Thus, a system and method for Chinese speech pitch extraction by using local optimized dynamic programming pitch path-tracking to meet the low time-delay requirements for many real-time speech recognition applications is described.

What is claimed is:

1. A method for Chinese speech pitch extraction, comprising:

pre-computing an anti-bias auto-correlation of a Hamming window function;

for at least one frame, saving a first candidate as an unvoiced candidate, and detecting other voiced candidates from the anti-bias auto-correlation function; and calculating a cost value for a pitch path according to a voiced/unvoiced intensity function based on the unvoiced and voice candidates, saving a predetermined number of least-cost paths, and outputting at least a portion of contiguous frames with low time delay.

2. The method of claim 1, further comprising:

smoothing a pitch contour to meet a modeling requirement.

3. The method of claim 1, further comprising:

normalizing a pitch contour to meet a clustering algorithm balance.

4. The method of claim 1, wherein the unvoiced intensity function is:

$$I(C_0) = VoicingThreshold + (1.0 - \sqrt{NormalizedEnergy})^2 (1.0 - VoicingThreshold); \text{ and}$$

the voiced intensity function is:

$$I(C_k) = R^*(m_k) * \left(\text{Minimum Weight} + \frac{\log_{10}[F(C_k) - F_{min}]}{\log_{10}[(F_{max}) - F_{min}]} * (1.0 - \text{Minimum Weight})\right).$$

5. The method of claim 1, further comprising calculating a cost value for a pitch path according to a transmit cost function, wherein the transmit cost function is:

$$TransmitCost(F_{i-1}, F_i) = TransmitCoefficient \log_{10}(1 + |F_{i-1} - F_i|).$$

6. The method of claim 1, further comprising removing global and local DC components.

7. The method of claim 1, wherein the anti-bias auto-correlation function is:

$$R_w(m) = \frac{1}{N} \sum_{n=0}^{N-1-|m|} hamming(n) hamming(n+m).$$

8. The method of claim 1, further comprising:

assigning a strength value to every candidate.

9. The method of claim 6, wherein the removing is performed through a notch-filtering operation.

10. The method of claim 1, further comprising:

segmenting a speech signal into a plurality of frames.

11. The method of claim 4, further comprising:

defining the $F_{max}$ and $F_{min}$ based on the characteristics of human pronunciation.

12. The method of claim 10 for each frame, the method further comprising:

calculating spectrum through a Fast Fourier Transform (FFT);

calculating power spectrum; and calculating auto-correlation through an Inverse Fourier [Fast?] Transform (IFFT).

13. The method of claim 1, further comprising:

performing Mel Frequency Cepstral Coefficients (MFCC) extraction.

14. A system for Chinese speech pitch extraction, comprising:

a preprocessor for pre-computing an anti-bias auto-correlation of a Hamming window function;

a pitch candidate estimator for at least one frame, saving a first candidate as an unvoiced candidate, and detecting other voiced candidates from the anti-bias auto-correlation function; and a local optimized dynamic processor for calculating a cost value for a pitch path according to a voiced/unvoiced intensity function based on the unvoiced and voice candidates, saving a predetermined number of least-cost paths, and outputting at least a portion of contiguous frames with low time delay.

15. The system of claim 14, further comprising:

a smoothing processor for smoothing a pitch contour to meet a modeling requirement.

16. The system of claim 14, further comprising:

a normalization processor for normalizing the pitch contour to meet a clustering algorithm balance.

17. The system of claim 14, wherein the unvoiced intensity function is:

$$I(C_0)=\text{VoicingThreshold}+(1.0-\sqrt{\text{NormalizedEnergy}})^2(1.0-\text{VoicingThreshold});\text{ and}$$

wherein the voiced intensity function is:

$$I(C_k) = R^*(m_k) * \left(\text{Minimum Weight} + \frac{\log_{10}[F(C_k) - F_{\min}]}{\log_{10}[(F_{\max}) - F_{\min}]} * (1.0 - \text{Minimum Weight})\right).$$

18. The system of claim 14, wherein the local optimized dynamic processor further calculates a cost value for a pitch path according to a transmit cost function, wherein the transmit cost function is:

$$\text{TransmitCost}(F_{i-1},F_i)=\text{TransmitCoefficient}\ \log_{10}(1+|F_{i-1}-F_i|).$$

19. The system of claim 14, wherein the preprocessor further removes global and local DC components.

20. A machine-readable medium having stored thereon executable code which causes a machine to perform a method for Chinese speech pitch extraction, the method comprising:

pre-computing an anti-bias auto-correlation of a Hamming window function;

for at least one frame, saving a first candidate as an unvoiced candidate, and detecting other voiced candidates from the anti-bias auto-correlation function; and calculating a cost value for a pitch path according to a voiced/unvoiced intensity function based on the unvoiced and voice candidates, saving a predetermined number of least-cost paths, and outputting at least a portion of contiguous frames with low time delay.

21. The machine-readable medium of claim 20, wherein the method further comprises:

smoothing a pitch contour to meet a modeling requirement.

22. The machine-readable medium of claim 20, wherein the method further comprises:

normalizing a pitch contour to meet a clustering algorithm balance.

23. The machine-readable medium of claim 20, wherein the unvoiced intensity function is:

$$I(C_0)=\text{VoicingThreshold}+(1.0-\sqrt{\text{NormalizedEnergy}})^2(1.0-\text{VoicingThreshold});\text{ and}$$

the voiced intensity function is:

$$I(C_k) = R^*(m_k) * \left(\text{Minimum Weight} + \frac{\log_{10}[F(C_k) - F_{\min}]}{\log_{10}[(F_{\max}) - F_{\min}]} * (1.0 - \text{Minimum Weight})\right).$$

24. The machine-readable medium of claim 20, wherein the method further comprises calculating a cost value for a pitch path according to a transmit cost function, wherein the transmit cost function is:

$$\text{TransmitCost}(F_{i-1},F_i)=\text{TransmitCoefficient}\ \log_{10}(1+|F_{i-1}-F_i|).$$

25. The machine-readable medium of claim 20, wherein the method further comprises removing global and local DC components.

26. The machine-readable medium of claim 20, wherein the anti-bias auto-correlation function is:

$$R_w(m) = \frac{1}{N}\sum_{n=0}^{N-1-|m|} \text{hamming}(n)\text{hamming}(n+m).$$

27. The machine-readable medium of claim 20, wherein the method further comprises:

segmenting a speech signal into a plurality of frames.

28. The machine-readable medium of claim 27 for each frame, wherein the method further comprises:

calculating spectrum through a Fast Fourier Transform (FFT);

calculating a power spectrum; and calculating an auto-correlation through an Inverse Fourier Transform (IFFT).

29. The machine-readable medium of claim 20, wherein the method further comprises:

performing Mel Frequency Cepstral Coefficients (MFCC) extraction.

* * * * *